United States Patent [19]

Lawlor

[11] Patent Number: 4,941,277

[45] Date of Patent: Jul. 17, 1990

[54] MOUNT FOR FIREARM SIGHT

[76] Inventor: Joseph A. Lawlor, Rte. 1, Box 149C, Emon Valley, Pa. 16120

[21] Appl. No.: 271,529

[22] Filed: Nov. 15, 1988

[51] Int. Cl.[5] ..... F41G 1/387

[52] U.S. Cl. ..... 42/100; 42/101; 42/102; 33/234; 33/245

[58] Field of Search ..... 42/100, 101, 102, 103; 33/233, 234, 245-250; 362/110, 111, 112, 113, 114

[56] References Cited

U.S. PATENT DOCUMENTS

| | | | |
|---|---|---|---|
| 1,057,518 | 4/1913 | Archer | 362/110 |
| 2,151,768 | 3/1939 | Humeston | 33/245 |
| 2,433,909 | 1/1948 | Jefferies | 42/100 |
| 3,222,022 | 12/1965 | Akin, Jr. | 248/316.1 |
| 3,260,001 | 7/1966 | Weaver | 33/245 |
| 3,292,264 | 12/1966 | Kincannon | 42/101 |
| 3,919,781 | 11/1975 | Chaba | 42/100 |
| 4,026,055 | 5/1977 | Weast | 42/101 |
| 4,299,044 | 11/1981 | Johannsen | 42/101 |
| 4,348,828 | 9/1982 | Snyder | 42/103 |
| 4,429,468 | 2/1984 | Jimenez et al. | 42/101 |
| 4,446,644 | 5/1984 | Jiminez et al. | 42/101 |
| 4,509,282 | 4/1985 | McMillon | 42/101 |

*Primary Examiner*—Charles T. Jordan
*Assistant Examiner*—Michael J. Carone
*Attorney, Agent, or Firm*—Clifford A. Poff

[57] ABSTRACT

For connecting known sight means such as scope sights to known rib firearms, there is provided a mounting means which has an upper portion having sight supporting surfaces adapted to cooperate with mounting surfaces formed on a lower portion of a sight, a lower portion comprising jaw members adapted to surround and grasp the rib, and a central portion therebetween of such dimensions and strength as to exhibit substantial ductility, the upper, lower, and central portions comprising an integral extrusion made of suitable metal such as aluminum, and the mounting device further comprising a plurality of fastener members adapted to urge the jaw members towards each other, with the lower portion of the extrusion piece having such dimensions and strength as not to be substantially deformed upon tightening of the fastener members.

26 Claims, 5 Drawing Sheets

MOUNT FOR FIREARM SIGHT

BACKGROUND OF THE INVENTION

1. Field of the Invention

The present invention relates to the art of mounting a sight upon a firearm, for example, a telescopic or rifle sight, and in particular, it relates to the art of providing for the mounting of a scope or sight upon a firearm which is provided with a rib like member such as a raised ventilated rib for a shotgun a solid frame part for a pistol, or a metal barrel part of a muzzleloader, in which a mounting device has a body and some connecting members, columns or stanchions that maintain the body with respect to the top of the firearm.

The invention more particularly relates to providing firearms of the well known types indicated above, with a telescope or other sight means, also of a well known type, the scope or sight having mounting structure including a lower gripping portion for allowing the mounting structure to be connected to the firearm, and in which the scope mounting structure and mounting device have a cooperative construction for interconnecting these two members in a supportive relationship.

2. Description of the Prior Art

Although it is true, as indicated above, that there are well known in the prior art various firearms (shotguns, pistols or muzzleloaders) of the kind indicated above, containing as to the two former a rib or like member and as to the latter the metal upper part of the barrel, a rib or like member, and although it is likewise true that there are well known in the prior art various sight means such as telescopic sights and slug sights, which are provided with downwardly extending gripper members having either interior concave V-shaped grooves or dove tail slots which extend longitudinally or transversely, respectively, of the barrel of the firearm, the prior art has not provided, prior to the present invention, satisfactory means enabling the latter to be mounted upon the former. The known ribs or like members do not necessarily, or even at all usually, have in their upper portions an exterior geometry to permit a satisfactory direct attachment, so that it has accordingly been necessary, in accordance with the prior art, to provide some sort of scope-mounting means between a rib or like member and a sight intended to be mounted thereon.

Of the known prior mounting means, all have exhibited certain drawbacks. Some are useful only with a particular one or two models of ribbed shotguns or pistols, or only with a certain one or two models of known sights. Some of them require for their use actual machining operations upon the barrel of the firearm, or the portion of it which receives the barrel, and it is desirable to avoid such machining operations, not only because of the inconvenience thereof, but also because of what they may do to the performance characteristics of the firearm. Some of the known mounting means are not sufficiently sturdy and secure to keep a sight, such as a telescopic sight, properly mounted, especially after the firearm is discharged, and in the case where a sturdier structure was attempted, the gripping action between the rib or frame and the mounting means tended to deflect the scope out of its desired mounting position. Moreover, some guns require that the scope be mounted on the receiver of the gun, for example, shot guns, which is then subject to the inherent relative movement between the receiver and barrel during firing.

Even more commonly, in the art of providing mounts for sights for firearms, there is provided a structure which is relatively complicated, being composed of several parts which must be separately manufactured and assembled, which lends to greater expense in manufacture and greater inconvenience in the process of assembly.

Examples, in general, of previous efforts in the art of providing mountings for sights for firearms may be found in U.S. Pat. Nos. 1,837,290; 3,040,433; 3,835,565; 3992,782; 4,026,055; 4,383,371; 4,429,468; 4,531,321; and 4,567,683. The above-mentioned patents, while not specifically addressing the problem of dealing with various kinds of firearms having a ventilated rib or rib like member illustrate nevertheless the various other above-mentioned disadvantages, i.e., the need to drill into the barrel, complicated structure, limited applicability and the inability to maintain the scope in the proper position due to the gripping force being exerted between the firearm and mounting means.

SUMMARY OF THE INVENTION

For connecting known sight means to known firearms, having a rib or rib like member there is provided a mounting means which has in an upper portion either a longitudinally extending opposed lateral exterior V-shaped holding surfaces, adapted to be gripped by a lower portion of a sight which has opposed interior V-shaped grooves extending longitudinally therein, or alternatively, transversely arranged cooperative supportive surfaces in the upper and lower portions, respectively, a lower portion comprising jaw members adapted to surround and grasp the rib, rib like member or metal part of the barrel and a central portion therebetween of such dimensions and strength as to exhibit substantial ductility, the upper, lower, and central portions comprising an integral extrusion made of suitable metal, such as aluminum, and the mounting device further comprising a plurality of fastener members adapted to urge the jaw members towards each other, with the lower portion of the extrusion having such dimensions and strength as not to be substantially deformed upon tightening of the fastener members, and permitting a range of straight parallel fastening positions by the jaw members. Such a mounting means is relatively inexpensive to manufacture and easy to use, and it solves the problem of satisfactorily mounting any of several kinds of known and commercially available sights to any of several types of firearms having a rib, rib like member, or metal barrel part.

DESCRIPTION OF THE DRAWINGS

The present invention will be better understood when read in light of the accompanying drawings in which: with the FIG. 1 is an end view, from the trigger end, transverse with respect to its length, of a first embodiment of a mounting device in accordance with the present invention, depicting also its physical relationship with the rib of a ventilated-rib firearm and a lower part of a telescopic-sight means.

DESCRIPTION OF THE PREFERRED EMBODIMENTS

Figure 1:
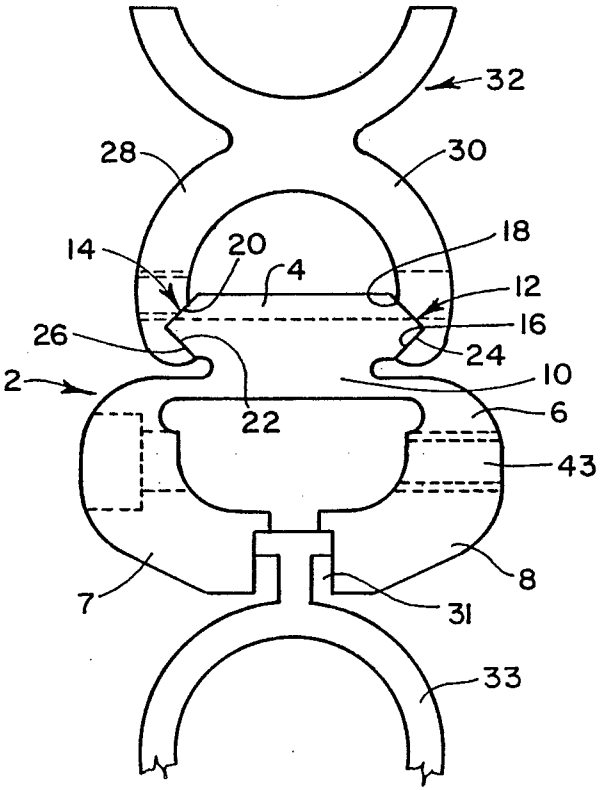

With reference first to FIG. 1, which is an end view of a mounting device 2 according to the invention, the device being particularly suitable for use with a shotgun or pistol. It has an upper portion 4, a lower portion 6 having jaws or legs 7 and 8, and between them, a central portion 10 which is of such dimensions of characteristics as to have a certain requisite or necessary substantial degree of flexibility. The above-described mounting device 2 is also, according to the invention, a unitary and integral piece of metal, preferably an extrusion of aluminum type 6061 with a heat treated temper of T6. The upper portion 4 has exterior V-shaped ridges 12 and 14 with surfaces 16, 18, 20, and 22, which are adapted to receive the corresponding surfaces 24, 26 of the bottom or gripper members 28, 30 of a bottom part 32 of a telescopic sight means. FIG. 1 also indicates the raised ventilated rib 31 and a firearm barrel 33, as viewed from the trigger end of the mounting device 2.

Figure 2:
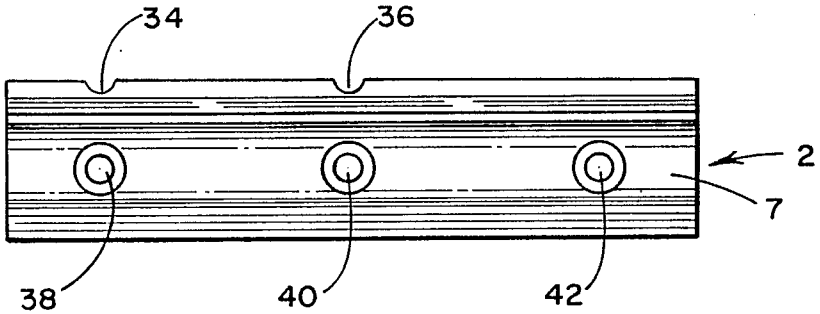
FIG. 2 is a side-elevation view, reduced in size from FIG. 1, of the first embodiment of the mounting device thereof.
Figure 3:
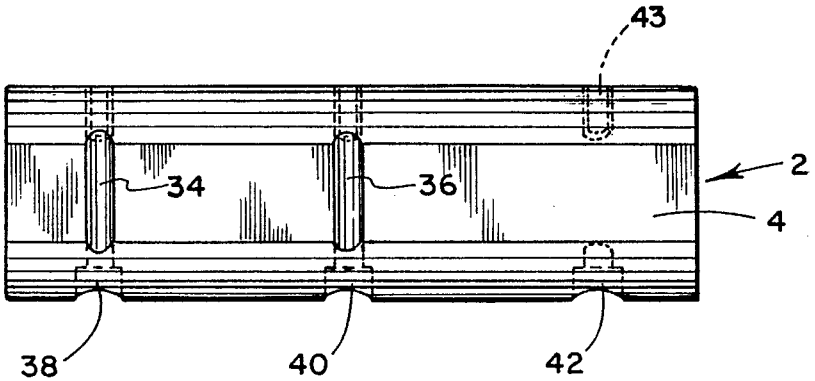
FIG. 3 is a plan view of the same scale as FIG. 2, of the first embodiment.

Referring now to FIGS. 2 and 3, it can be seen that the upper portion 4 has therein a pair of transversely extending hemicylindrical slots 34 and 36. Figure also shows the heads 38, 40, 42 of cap screw fasteners received in jaw member 7 for securing together the jaw members 7 and 8 by their threaded connection with threaded holes 43 drilled and tapped in the jaw member 8, these screws not being shown in FIGS. 1 and 3, where only their holes are shown.

The present invention is addressed to the fact that there now exists on the market in the United States and other parts of the World, ceratin number of kinds of vent and non-vented ribbed firearms and a certain number of types of scope sights of a kind having downwardly extending gripper members having interiorly thereof some surfaces meeting at a solid angle of 90 degrees for grasping onto something which is on said firearm or a mounting means attached thereto. Accordingly, as noted, it is an object of the present invention to provide a mounting means which is capable of use for attaching most or all of the former or most or all of latter, by a construction and arrangement of having a sight mount means in the form of a unitary extrusion with a top part of the correct geometry.

The mount means also has a bottom part with sufficient strength to resist substantial deformation when fastener means 38, 40, 42 are used to urge the same toward each other to grasp a vent rib, and between them, a central portion thick enough to have adequate strength but thin enough to have a certain degree of flexibility which at a minimum is just enough to keep the set sight properly held when subject to the shock of having the firearm fired, and not disturb the resistance to deformation of the top part and still allow the opposed fastening faces of the jaws 7 and 8 to fasten a number of different thickness ribs. In this arrangement the material of construction and the adherence to certain dimensional characteristics assure the optimum results which characteristics will be now set forth as to one particular example.

One of the important aspects is the selection of the material of construction of the mount of aluminum alloy of the 6061 type with a heat treated temper of T6, which as a type of material is generally well known in the art.

In this given case, with the understanding the state parameters are approximate, the aluminum may be an extrusion which has a top flat surface of $\frac{5}{8}$ inch by $4\frac{1}{4}$ inches. The slots 34 and 36 as viewed from FIGS. 2 and 3, may have an overall width of 5/32 inch, a depth of 3/32 inch, and a radius of 5/64 inch, being spaced apart by $1\frac{5}{8}$ inches. The upper portion 4 as viewed from FIG. 1, has an overall thickness of 9/32 inch, the side portions with the shaped surfaces 16, 18, 20, and 22 having a vertical extent of 0.220 inch, below which, there is an annularly extending portion with a radius of 0.030 inch. As noted, the upper portion 4 is constructed to have sufficient strength to resist substantial deformation during fastening.

The central portion, also viewed from FIG. 1, is dimensioned to provide sufficient strength but yet substantial ductility and hence provide a required predetermined flexibility, having an overall vertical thickness of 0.065 inch. The downwardly extending jaw members, as viewed in FIG. 1, each have a horizontal thickness of 5/16 inch and a vertical thickness of 5/16 inch, as to the extreme opposite facing ends thereof, wherein the construction will resist substantial deformation upon tightening of the jaw members. In this case the jaws may be suitable to effectively grasp, for example, three difference thickness rib members, in which the thinnest may be 0.270 and the thickest 0.385 inches. The cap screws 38, 40, and 42 may have an overall length of 1.25 to 1.75 inches, in which the outside dimensions of the mounting device as viewed in FIG. 1 are $1\frac{3}{8}$ inches wide and 1-1/32 inches high.

Figure 4B:
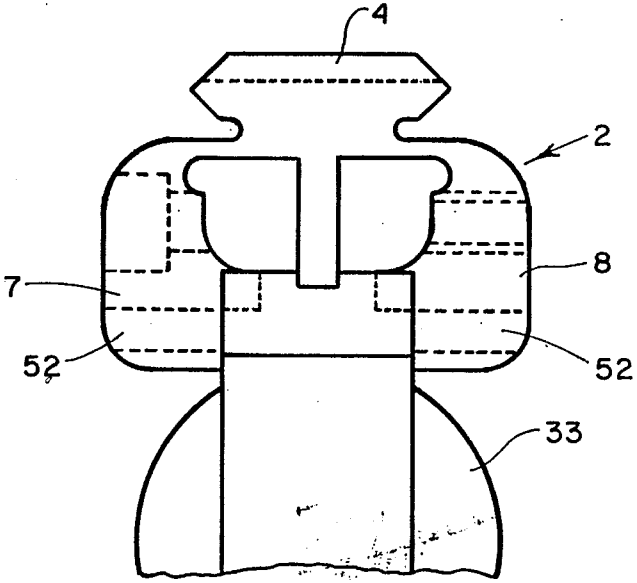
FIGS. 4A and 4B are views similar to FIGS. 1 and 2, of a second embodiment of a mounting device in accordance with the present invention.
Figure 5:
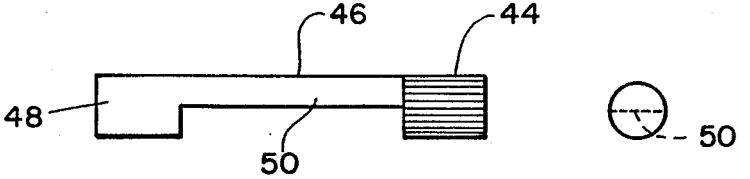
FIG. 5 includes front and end views of a recoil pin which may be used with the mounting device of FIGS. 4A and 4B.
Figure 4A:
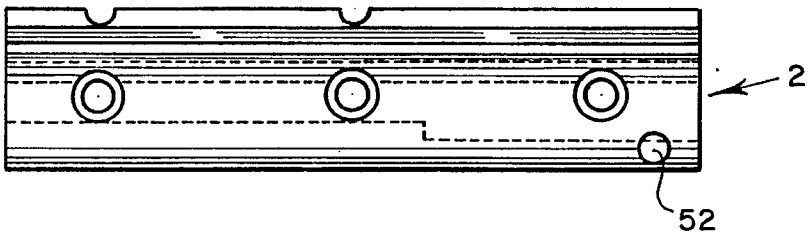

While in many cases the embodiment of FIG. 1 may be very successfully used for both shot guns and pistols, for some forms of pistols it may be desired to add some additional rigidity with reference to high recoil conditions by adding a recoil pin, as illustrated in FIGS. 4A, 4B, and 5.

The pin consists of a knurl end 44 having a reduced center portion 46 and a rounded opposite end 48, the 46 portion having a flat lower surface at 50. The pin passes through a drilled hole 52 shown in FIGS. 4A and 4B. It is to be understood, as to the embodiment of FIGS. 4A and 4B, aside from the overall difference in shape of the lower portion of the jaw members 7 and 8 and the difference in the particular shape of the inside portion of the lower portion of the jaw member the parts correspond to similar parts shown in FIGS. 1, 2, and 3 and therefore will not be identified again. The two noted differences in the jaw portions are designed particularly for use with a pistol where the mounting device is attached to the top of the frame of the pistol and there is provided a downwardly extending member having its lower end received in a horizontal slight slot machined in the top of the pistol frame.

Figure 6:
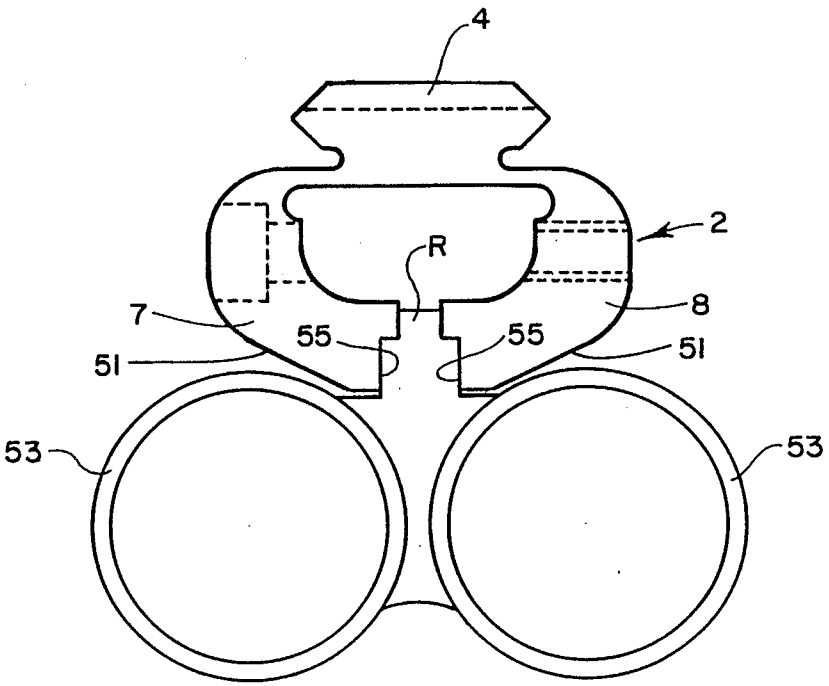
FIG. 6 is a view, similar to FIG. 1, of a third embodiment of a mounting device in a double barrel shotgun in accordance with the present invention.
Figure 7:
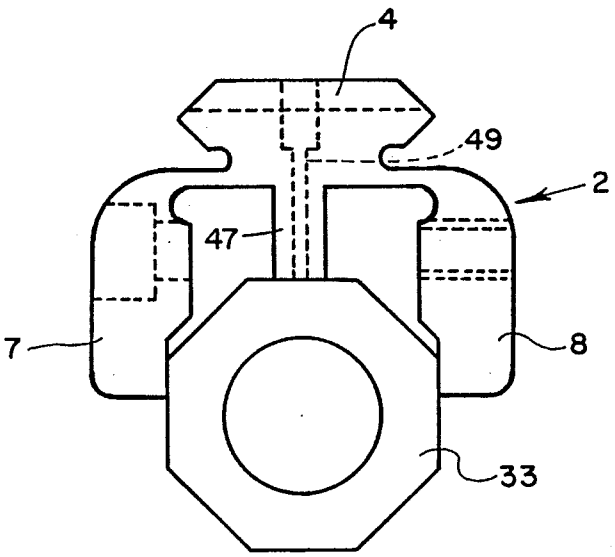
FIG. 7 is a view, similar to FIG. 1, of a fourth embodiment of a mounting device in accordance with the present invention.

Turning now to FIGS. 6 and 7, as noted in regard to FIGS. 4A and 4B the main differences when compacted to FIG. 1 is the overall shape of the lower portions of the jaw members and particularly the lower inside portions, which as in the case of FIGS. 4A and 4B, relate to the particularly type of firearm to which the mounting device is to be used, namely, a double barrel shot gun. In the case of FIG. 6 embodiment, the mounting device is designed to be employed with a shot gun having a solid raised rib instead of the ventilated rib 31 of FIG. 1, and in the use of the FIG. 7 mounting device, the device is designed for us with a muzzleloader, for example, a pistol or muzzleloader rifle. As in the case of FIGS. 4A and 4B, and for the reasons stated with respect thereto, in FIGS. 6 and 7, only the jaw members 7 and 8 have been identified. In FIG. 7 there is indicated a center post 47 for registering a mounting device for alignment of the scope and barrel by a screw received in a threaded hole 49. Also it is to be noted that the mounting device is secured to the octagonally shaped barrel of the muzzleloader. There are two other important features of the FIG. 6 embodiment. The lower outside portions of the mounting device have special curved surfaces 51 that match the adjacent upper surfaces of an associated barrel 53 of a double barrel shotgun. This construction permits the formation of a substantial cutout portion 55 at the center portion of the mounting device to receive a sufficient part of the rib R to firmly hold the mounting device to the rib.

Figure 8:
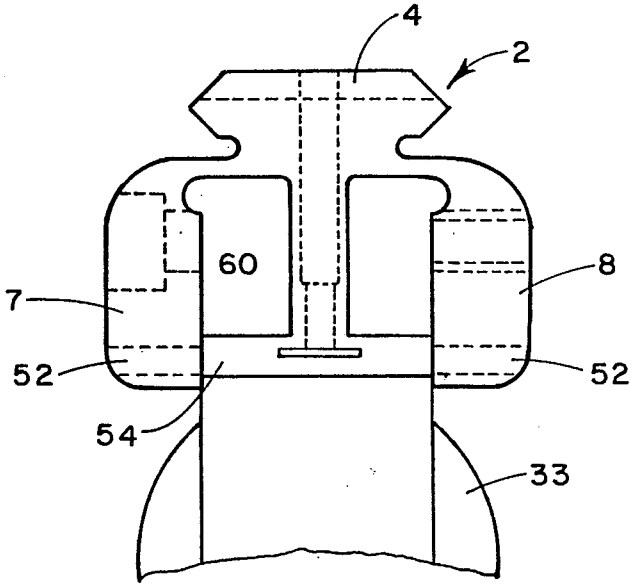
FIGS. 8, 9, and 10 are views, similar to FIGS. 1, 2, and 3, respectively, of a fifth embodiment of a mounting device in accordance with the present invention.
Figure 10:
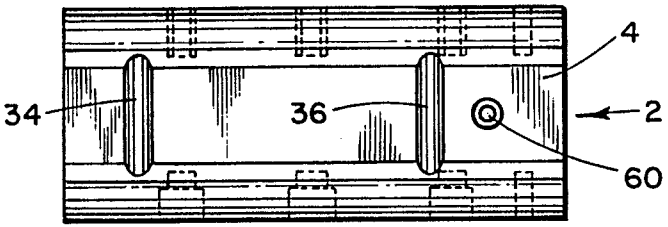
Figure 9:
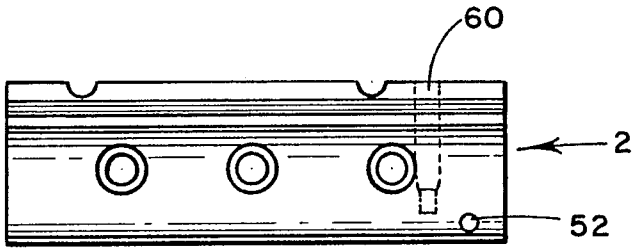

With reference now to FIGS. 8, 9, and 10, it may be assumed that the parts of the mounting device are similar to the earlier embodiments so that only the important differences will be noted. This mounting device is designed for a pistol where maximum rigidity against movement of the sight relative to the barrel is required. As noted, pistols have a top frame member of the shape shown at 54 in FIG. 8 having a clearance between its lower surface and the barrel 33 permitting rotation of the latter. FIGS. 8, 9, and 10 give a more complete showing of the holes 52 for the recoil pin 44–48 shown in FIGS. 4A, 4B, and 5.

In the embodiment of FIG. 8 the jaw members are formed to accommodate the particular shape of the top part of the frame 54 of the pistol and has one additional feature of providing a centrally downwardly projecting member 60 designed to have its lower end engage the upper adjacent surface of the existing sight slot in the frame 54.

A bored hole is provided in the member 60 for the purpose of receiving a gun screw, not shown, that threadedly engages a tapped hole in the member 50, the member is indicated in FIG. 9 extends the full length of the mount. While not indicated in the drawings, it is to be understood that the recoil pin 44–48 passes in front of the member 50 and also to one side of the cap screw 42, thus requiring no machining of the parts of the cap screw 42, thus requiring no machining of the parts of the pistol. As viewed from the trigger end of the firearm, in this embodiment the improved design of the mounting device, including the function of the central portion in allowing the jaw members to move parallel and forcibly engage the member 54, in which the inherent resistance of the jaws against deformation coupled with the use of the recoil pin and gun screw will allow for the maximum holding effect for the gun sight in those cases where the pistol requires this.

Figure 11:
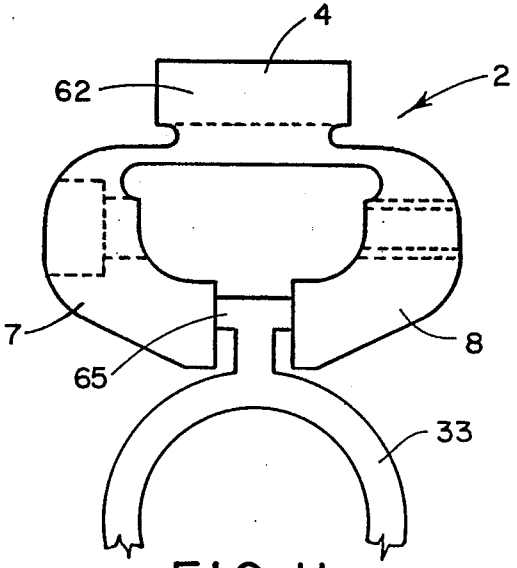
FIGS. 11, 12, and 13 are views, similar to FIGS. 1, 2, and 3, respectively, of a sixth embodiment of a mounting device in accordance with the present invention for a non-scope firearm sight.
Figure 13:
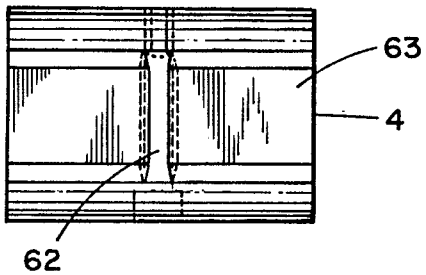
Figure 12:
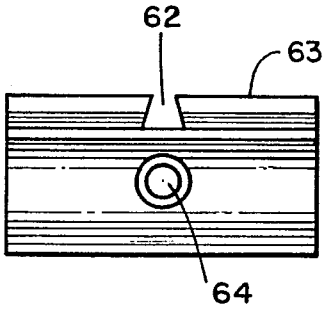

Turning now to FIGS. 11, 12, and 13 which relates to a mounting device for mounting, for example, a rifle type sight on a ribbed barrel shotgun, that may be easily changed by employing the mounting device of the present invention. Again only the difference in construction when compared with the earlier embodiments will be noted by additional reference numbers, when necessary. In order to receive the lower part of a standard rifle sight a transversely arranged dove tailed slot 62 is provided at the surface 63 of the upper member 4 of the mounting device 2, the slot being best shown in FIGS. 12 and 13. This slot takes the place of the slots 34 and 36 shown in FIGS. 2 and 3. The mounting device as shown in FIGS. 12 and 13 due to the longitudinal dimension of the usual rifle sight is made much shorter than the mounting devices of the earlier described embodiments, being secured to the rib of the firearm by a single cap screw 64 which functions the same as the screws 38, 40, and 42 of the embodiment of FIG. 1. In FIG. 11, the rib section of a shot gun is shown to take the form of a T-shaped member 64 when viewed from the trigger end.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

I claim as my invention:

1. A device used to carry a mount for a firearm sight, said device comprising:

an upper portion having surfaces constructed and arranged to receive mounting structure of a firearm sight;

a lower portion comprising jaw members adapted to grasp a firearm;

a central portion joining said upper portion and said lower portion, said upper, central and lower portions forming a one-piece construction; and fastening means adapted to urge said jaw members toward one another and into a firearm grasping position, wherein said upper portion has dimensions sufficient to give said upper portion strength to resist substantial deformation during fastening by said fastening means, said central portion has dimensions to give said central portion sufficient strength and ductility to assure a predetermined flexibility so as not to disturb said resistance to substantial deformation of said upper portion and to allow said jaw members to self-adjust to a plurality of fastening positions during fastening by said fastening means, and said lower portion has dimensions so as to resist substantial deformation during fastening by said fastening means.

2. The device as defined in claim 1 wherein said jaw members have opposed similar cooperative jaw faces, and said flexibility of said central portion is such that said jaw faces are maintained parallel to one another in said plurality of fastening positions.

3. A mount device as defined in claim 1 wherein said central portion has a substantial flexibility compared to the rigidity of said upper and lower portions.

4. The device as defined in claim 1 wherein said jaw members include corresponding cooperative openings arranged on the side of said jaw members furthest away from said central portion;

recoil pin means received in said openings and having a portion that passes through one of said openings in one of said jaw members for selective engagement with an outside surface of said one of said jaw members; and said recoil pin means also having a head portion that engages an outside surface of an opposite jaw member to lend rigidity to said mounting device on the recoil of the firearm.

5. The device as defined in claim 1 wherein said upper, central and lower portions form a one-piece extrusion made of type 6061 aluminum with a heat treat temper of T6 and said central portion comprises a segment for each jaw member adjacent an associated jaw member extending perpendicularly relative to said jaw members and having a thickness substantially thinner than the individual thicknesses of said upper portion and said lower portion.

6. The device as defined in claim 1 wherein said fastening means comprise screw or bolt members having a head portion adapted to bear upon a first one of said jaw members and distal from said head portion a portion received threadedly within a second and opposite one of said jaw members.

7. The device as defined in claim 1 wherein a top surface of said upper portion has therein a pair of transversely extending hemicylindrical slots to aid in the securing and positioning of said sight with respect to said device.

8. The device as defined in claim 1 wherein said sight consists of a telescopic sight.

9. The device as defined in claim 1 wherein said sight consists of a non-telescopic rifle type sight.

10. The device as defined in claim 1 wherein a top surface of said upper portion has a transversely extending dove tail shaped slot to aid in the securing and positioning of said sight with respect to said device.

11. The device as defined in claim 1 wherein said jaw members are constructed and arranged to grasp a rib-like member provided on said firearm.

12. The device as defined in claim 11 wherein said rib-like member comprises a ventilated rib of a shot gun.

13. The device as defined in claim 11 wherein said central portion includes a projecting portion arranged between, parallel and centered with respect to said jaw members, said projecting portion having an outer end adapted to contact an adjacent surface of said rib-like member, and securing means passing through said projecting portion for securing said projecting portion to said rib-like member.

14. The device as defined in claim 13, wherein said upper and central portions and said projecting portion each include a similar cooperative opening for receiving said securing means.

15. The device as defined in claim 11 wherein said rib-like member comprises an upper portion of the frame of a pistol.

16. The device as defined in claim 11 wherein said rib-like member comprises an upper portion of a metal barrel of a muzzleloader.

17. The device as defined in claim 11 wherein said lower portion includes two curved portions formed on its lower surface, said curved portions formed to generally match adjacent curved portions of a different one of the barrels of a double barrel gun, the construction being such that the device is provided with a substantially deep opening for firmly holding a portion of the rib-like member.

18. The device as defined in claim 11 wherein said lower portion includes two opposed horizontally and inwardly extending projections each forming lower shoulders arranged to be engaged by said rib-like member of the firearm for holding the device away from the barrel of the firearm.

19. the device as defined in claim 11 wherein said device is adapted to be mounted on a barrel portion of the firearm having said rib-like member.

20. A mounting device for mounting a sight to a ventilated rib positioned longitudinally along and above a barrel of a shotgun, the mounting device and the sight each having a plurality of cooperative inter-engaging supporting surfaces for the purpose of mounting the sight to the mounting device, said device comprising a first piece which a is an integral member made of metal having suitable characteristics, features, and dimensions such that said piece comprises;

an upper portion having the sight supporting surfaces of the mounting device formed thereon;

a lower portion comprising jaw members adapted to grasp said rib on opposite corresponding longitudinal sides thereof;

therebetween a central portion of such dimensions and strength as to exhibit a desired flexibility; and said device further comprising a plurality of fastener members adapted to urge said jaw members toward each other into a sight holding position, said jaw members having such dimensions and strength as not to be substantially deformed upon tightening of said fastener members.

21. A mounting device for mounting a sight to a rib-like member positioned longitudinally along and above a barrel of a firearm, the mounting device and the sight each having a plurality of cooperative inter-engaging supporting surfaces for the purpose of mounting the sight to the mounting device, said device comprising a first piece which is an integral member made of metal having suitable characteristics, features, and dimensions such that said piece comprises:

an upper portion having the sight supporting surfaces of the mounting device formed thereon;

a lower portion comprising jaw members adapted to grasp said rib-like member on opposite corresponding longitudinal sides thereof;

therebetween a central portion of such dimensions and strength as to exhibit a desired flexibility;

said jaw members include corresponding cooperative openings arranged on the side of said jaw members furthest away from said central portion;

recoil pin means received in said openings, said recoil pin means having a portion that passes through one of said openings in one of said jaw members for selective engagement with an outside surface of said one of said jaw members;

said recoil pin means also having a head portion that engages an outside surface of an opposite jaw member to lend rigidity to said mounting device on the recoil of the firearm; and said device further comprising a plurality of fastener members adapted to urge said jaw members toward each other into a sight holding position, said jaw members having such dimensions and strength as not to be substantially deformed upon tightening of said fastener members.

22. A mounting device for mounting a sight to a rib-like member positioned longitudinally along and above a barrel of a firearm, the mounting device and the sight each having a plurality of cooperative inter-engaging supporting surfaces for the purpose of mounting the sight to the mounting device, said device comprising a first piece which is an integral member made of metal having suitable characteristics, features, and dimensions such that said piece comprises:

an upper portion having the sight supporting surfaces of the mounting device formed thereon;

a lower portion comprising jaw members adapted to grasp said rib-like member on opposite corresponding longitudinal sides thereof;

therebetween a central portion of such dimensions and strength as to exhibit a desired flexibility;

said central portion including a projecting portion arranged between, parallel and centered with respect to said jaw members, said projecting portion having an outer end adapted to contact an adjacent surface of said rib-like member;

securing means passing through said projecting portion for securing said projecting portion to said rib-like member; and said device further comprising a plurality of fastener members adapted to urge said jaw members toward each other into a sight holding position , said jaw members having such dimensions and strength as not to be substantially deformed upon tightening of said fastener members.

23. A mounting device as defined in claim 22 wherein said upper and central portion said projecting portion each include a similar cooperative opening for receiving said securing means.

24. A mounting device for mounting a sight to a rib-like member positioned longitudinally along and above a barrel of a firearm, the mounting device and the sight each having a plurality of cooperative inter-engaging supporting surfaces for the purpose of mounting the sight to the mounting device, said device comprising a first piece which is an integral member made of metal having suitable characteristics, features, and dimensions such that said piece comprises;

an upper portion having the sight supporting surfaces of the mounting device formed thereon;

therebetween a central portion of such dimensions and strength as to exhibit a desired flexibility; and said device further comprising a plurality of fastener members adapted to urge said jaw members toward each other into a sight holding position, said jaw members having such dimensions and strength as not to be substantially deformed upon tightening of said fastener members, wherein first piece is an extrusion made of type 6061 aluminum with a heat treat temper of T6 and said central portion comprises a segment for each jaw member adjacent an associated jaw member extending perpendicularly relative to said jaw members and having a thickness substantially thinner than the individual thicknesses of said upper portion and said lower portion.

25. A mounting device for mounting a sight to an upper portion of a metal barrel of a muzzleloader, the mounting device and the sight each having a plurality of cooperative inter-engaging supporting surfaces for the purpose of mounting the sight to the mounting device, said device comprising a first piece which is an integral member made of metal having suitable characteristics, features, and dimensions such that said piece comprises;

an upper portion having the sight supporting surfaces of the mounting device formed thereon;

a lower portion comprising jaw members adapted to grasp said barrel on opposite corresponding longitudinal sides thereof;

therebetween a central portion of such dimensions and strength as to exhibit a desired flexibility; and said device further comprising a plurality of fastener members adapted to urge said jaw members toward each other into a sight holding position, said jaw members having such dimensions and strength as not to be substantially deformed upon tightening of said fastener members.

26. A mounting device for mounting a sight to a rib-like member positioned longitudinally along and above a barrel of a firearm, the mounting device and the sight each having a plurality of cooperative inter-engaging supporting surfaces for the purpose of mounting the sight to the mounting device, said device comprising a first piece which is an integral member made of metal having suitable characteristics, features, and dimensions such that said piece comprises;

an upper portion having the sight supporting surfaces of the mounting device formed thereon;

a lower portion comprising jaw members adapted to grasp said rib-like member on opposite corresponding longitudinal sides thereof;

therebetween a central portion of such dimensions and strength as to exhibit a desired flexibility;

said lower portion including two curved portions formed on its lower surface, said curved portions formed to generally match adjacent curved portions of a different one of the barrels of a double barrel gun, the construction being such that the mounting device is provided with a substantially deep opening for firmly holding a portion of the rib-like member; and said device further comprising a plurality of fastener members adapted to urge said jaw members toward each other into a sight holding position, said jaw members having such dimensions and strength as not to be substantially deformed upon tightening of said fastener members.

* * * * *